US009775475B2

(12) United States Patent
Falk

(10) Patent No.: US 9,775,475 B2
(45) Date of Patent: Oct. 3, 2017

(54) LATCHING DEVICE FOR SELECTIVELY LIFTING TOILET LID OR COMBINATION OF TOILET LID AND SEAT

(71) Applicant: Ned Falk, Atlanta, GA (US)

(72) Inventor: Ned Falk, Atlanta, GA (US)

( * ) Notice: Subject to any disclaimer, the term of this patent is extended or adjusted under 35 U.S.C. 154(b) by 243 days.

(21) Appl. No.: 14/521,691

(22) Filed: Oct. 23, 2014

(65) Prior Publication Data

US 2015/0230674 A1 Aug. 20, 2015

Related U.S. Application Data

(60) Provisional application No. 61/940,052, filed on Feb. 14, 2014.

(51) Int. Cl.
*A47K 13/10* (2006.01)

(52) U.S. Cl.
CPC ..... *A47K 13/10* (2013.01)

(58) Field of Classification Search
CPC ..... A47K 13/10
USPC ..... 4/234, 242.1, 246.1, 253
See application file for complete search history.

(56) References Cited

U.S. PATENT DOCUMENTS 7,958,575 B2 * 6/2011 Fullerton ..... H01F 7/0242 4/242.1
8,176,576 B2 * 5/2012 Moore ..... A47K 13/242 4/253

* cited by examiner

*Primary Examiner* — Tuan N Nguyen

(57) ABSTRACT

A toilet seat and lid assembly comprising a toilet seat lid (also known as a cover) equipped with both fixed and movable grab area equipped with a lever or with a slide switch. The movable area of the grab or the slide switch integrates with the seat below through a latch. Lifting the lid by using the lever or sliding the switch, disconnects the lid from the seat and lifts only lid. Lifting the lid using the fixed grab area of the lid or without sliding the switch, does not disengage the seat and thus results in the lifting of the integrated seat and lid at the same time. Methods of using the same are also provided.

18 Claims, 12 Drawing Sheets

FIG. 4A
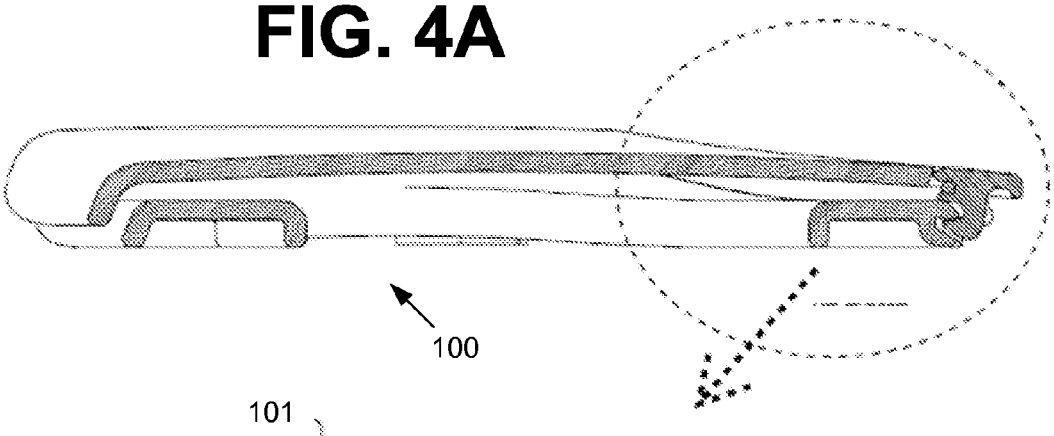
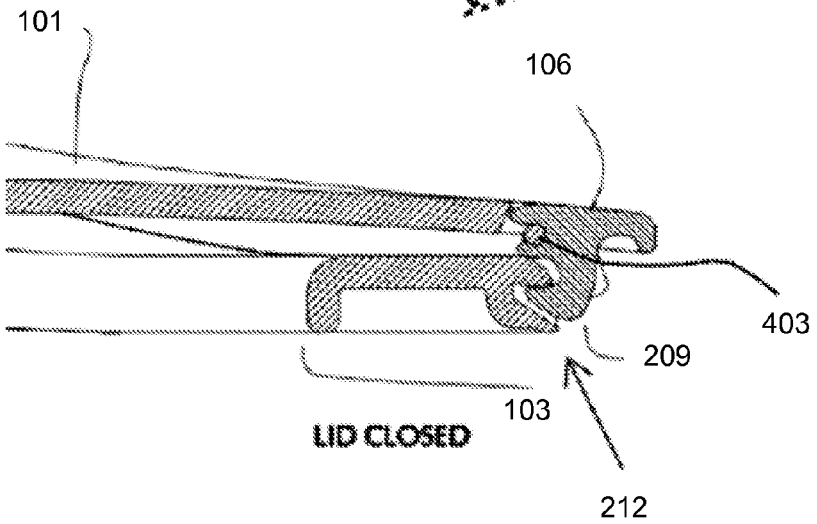
FIG. 4B

700

LATCHING DEVICE FOR SELECTIVELY LIFTING TOILET LID OR COMBINATION OF TOILET LID AND SEAT

CROSS-REFERENCE TO RELATED APPLICATIONS

The present application claims the benefit of U.S. Provisional Application No. 61/940,052, filed on Feb. 14, 2014, and entitled "Integrated Toilet Seat and Lid," which is incorporated herein by reference in its entirety.

BACKGROUND

In this day and age, many people utilize toilets when eliminating bodily waste. During the proper use of the toilet, users may manipulate the toilet seat and/or lid depending on which type of waste they are eliminating, which gender they are, and whether a lid is present. In many cases, the user encounters a lid covering a seat, and the seat forming a ring around the toilet bowl. When necessary, for men and women in the case of bowel movements, and normally women only when solely urinating, a user generally sits on the toilet seat evacuating waste into the toilet bowl. Normally when men urinate, they do so standing up, directly into the bowl with the seat lifted to expose the entire bowl. If a lid is encountered, it must be lifted before the toilet can be used.

If the user is male and intends to urinate, if he encounters a toilet with both the lid and seat in the downward position, both components must be lifted. If the male user intends to use the toilet for a bowel movement, only the lid would require lifting to the upright position to expose the seat. If the lid and seat were both upright, when a male user approaches the toilet, he would only take action to lower the seat if he needs to eliminate bowel waste.

In the female scenario, since both uses of the toilet require sitting, if the user encountered the lid and seat in the downward position, she would need to lift only the lid to access the seat for sitting. If she encountered the seat and lid in the upward position, she would need to lower the seat prior to use.

Typically, toilet lids and seats are attached with hinges to the bowl at the back and pivot around these hinges to allow for moving of the lid and/or seat as needed in the scenarios described above. In most designs, when in the upright position away from the toilet bowl, the lid and/or the seat stays in this position, as it rests on the toilet tank.

Restrooms in general, and toilet seats in particular, are often unsanitary. This is so often the case that in many locations liners are supplied to eliminate direct contact between the body of the user and the seat. Many reasons exist to cause a very unsanitary seat, such as dirty water splashing on the seat during the toilet flush, prior users of a toilet having germs on their posterior, or even worse someone urinating on the seat by not bothering to lift it. As a matter of fact, the environment around a toilet seat can be so germ infested that the use of the lid is primarily recommended not for aesthetics but to minimize the spread of germs that might get airborne.

Although never touching anything in the restroom or on the toilet would be the best scenario, unfortunately the complex automation of mechanical devices that would be needed may be cost prohibitive to most people.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

FIGS. 1-6 show an embodiment of the present disclosure which utilizes a hook as the latching feature. In this embodiment of the present disclosure, the hook is attached to a lever that pivots in the lid and connects to a cooperable feature in the seat, depicted as a notch in this embodiment. This embodiment will be referred to as "the hook" in the remainder of this disclosure.

FIGS. 7-11 show an embodiment of the present disclosure which utilizes a magnetic attraction to selectively latch or unlatch the seat and the lid. This embodiment is referred to as "the magnet" in the remainder of this disclosure.

FIG. 1 illustrates a top down perspective view of a toilet seat lid and a toilet seat equipped with the hook embodiment of the present disclosure.

FIGS. 2A and 2B illustrates a side view of a toilet lid and toilet seat equipped with the hook embodiment of the present disclosure, where FIG. 2B is a magnified view.

FIG. 3 illustrates a frontal view of a toilet lid and toilet seat equipped with the hook embodiment of the present disclosure.

FIG. 4 illustrates a cross section view of a toilet lid and toilet seat equipped with the hook embodiment of the present disclosure. It is depicted with the lid down.

FIG. 5 illustrates a cross section view of a toilet lid and toilet seat equipped with the hook embodiment of the present disclosure. It is depicted with the lever lifted, to disengage the seat.

FIG. 6 illustrates a cross section view of a toilet lid and toilet seat equipped with the hook embodiment of the present disclosure. It is depicted with the lid returning to a horizontally disposed position.

FIG. 7 illustrates a frontal perspective view of a toilet seat lid and a toilet seat equipped with the magnet embodiment of the present disclosure.

FIG. 8 illustrates a partially side view of a toilet lid and toilet seat equipped with the magnet embodiment of the present disclosure.

FIG. 9 illustrates a magnified cross section view of a toilet lid and toilet seat equipped with the magnet embodiment of the present disclosure. It is depicted with the lever portion of the lid magnetically latched to the seat.

FIG. 10B is the magnified view.

FIG. 11 illustrates a cross section view of a toilet lid and toilet seat equipped with the magnet embodiment of the present disclosure. It is depicted with the lid partially raised up.

DETAILED DESCRIPTION

The present disclosure relates to a latching device integrated with a toilet seat and lid. Specifically, a latching device attaches the lid to the seat allowing them to be moved together, or separately allowing the movement of just the lid. Methods of using the same are further provided. In various embodiments, the operations of raising or lowering (collectively referred to as moving) the toilet lid and/or seat is done with nearly the same normal motion people currently use. For purposes of the present disclosure, it is assumed that male urination will be performed while standing up, with both the lid and seat in the upright position, away from the urine flow (herein referred to as "standing mode"). All other uses of the toilet to eliminate waste for men and women are assumed to be performed while sitting on the seat, with the lid raised against the toilet tank (herein referred to as "sitting mode").

In one embodiment of the present disclosure, a hook is molded into a lever that is hinged into the lid. The hook component of the lid engages a notch in the seat as the attachment method. When the lid is moved and the seat is in the engaged mode, both the lid and the seat are moved as a set. When the lever in the lid is lifted, this disengages the seat and only the lid is raised.

An alternate embodiment of the present disclosure also utilizes a lever hinged into the lid, which engages the seat. In this embodiment, however, the attachment method is magnetic. Either a magnet embedded into the lever attracts a magnetic element embedded in seat. Alternatively, the magnet could be embedded in the seat engaging a magnetic element embedded in the lever as the latching mechanism. Two magnets could be used as the attachment method embedded in the seat and the other in the lever, as long as these magnets were embedded in such a way as to ensure the polarity of the magnets is set to attract each other. In any case, the process of lifting the lever breaks the magnetic bond again allowing the lid to be raised without the seat. As in the first embodiment, lifting the lid without touching the lever part of the lid moves both the lid and the seat.

Figure 1:
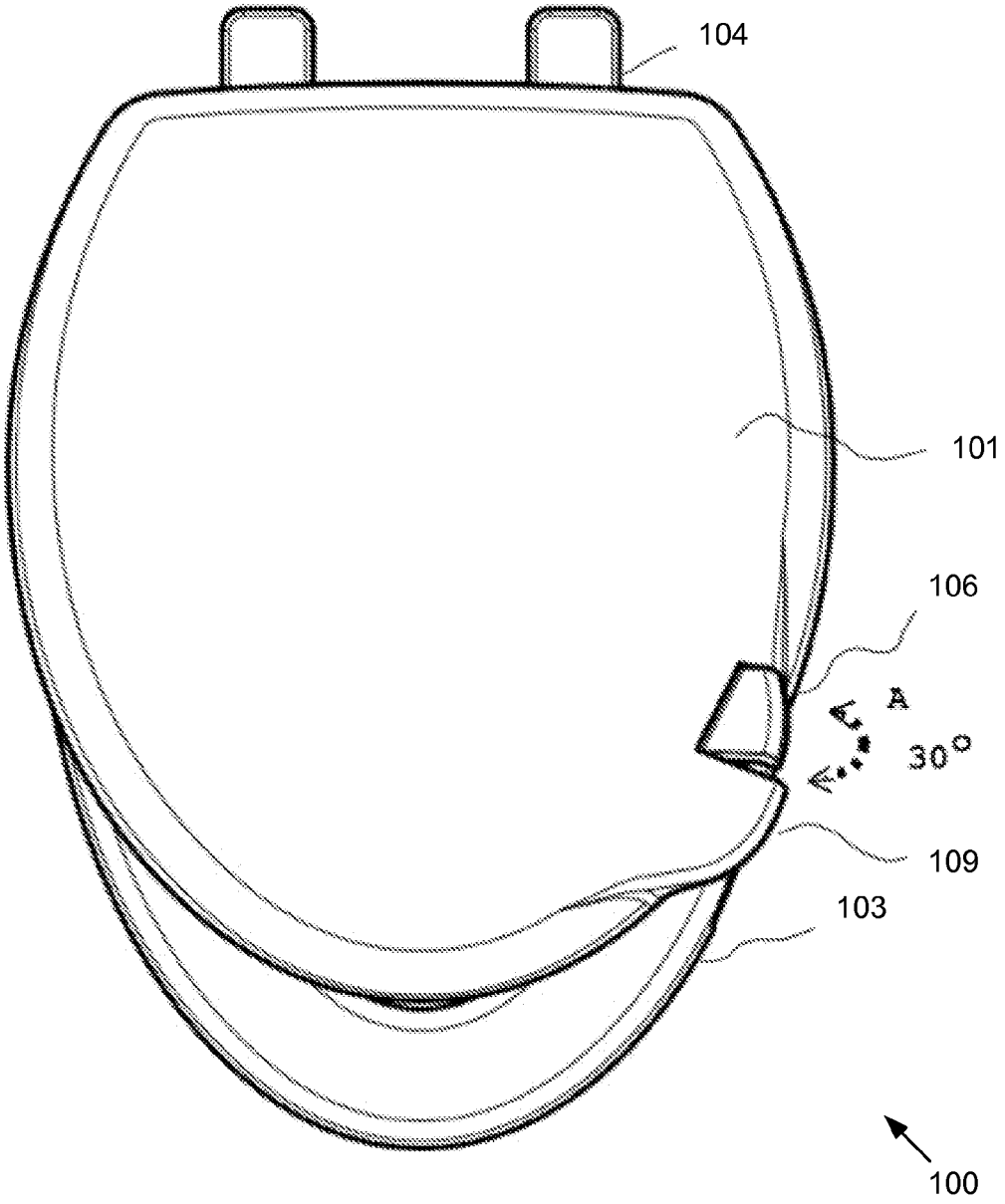

Turning now to FIG. 1, illustrated is a top down perspective view of an integrated toilet seat and lid 100, including a toilet lid 101 and seat 103, which are coupled via hinges 104. Lever 106 is attached to a hinge point in the lid 101. This lever is positioned next to a fixed grab point 109 in the lid 101. Not visible from this perspective is the hook portion of the lever 106, which attaches to a notch in the side of the seat 103, which is also not visible in this view.

For purposes of discussion, operation in both sitting and standing mode will assume that the lid 101 and seat 103 are starting from the horizontal position, as the proper use of the toilet involves returning the lid 101 to the horizontal position prior to flushing the waste away. This keeps toilet germs contained in the bowl area. To return the lid 101 (and seat 103 below if both are raised) to the horizontal position, the user need only to grab the lid 101 at grab point 109. If the seat 103 is also upright, both will be moved when the lid 101 is lowered.

If a male approaches the toilet with the lid 101 and seat 103 both down in the horizontal position and needs to use the toilet in standing mode, he lifts the lid 101 at the fixed grab point 109. Moving the lid 101 from this area keeps the seat 103 below attached, thus moving both elements of the toilet together, without touching the germ-infested seat 103. This is because a hook component of the lever 106 is not disengaged when grabbing the lid 101 from area 109. Details of this hook component of the lever 106 and how it engages the seat 103 are shown in FIGS. 2-6.

If a toilet user desires sitting mode, the lid 101 would be raised by lifting by the lid 101 at the lever 106, or by using a finger on the lever 106 to raise it slightly while using the rest of the hand on the fixed grab point 109. Lifting the lid 101 in this way disengages the hook from the notch in the seat 103 below, thus allowing for the seat 103 to remain on the toilet bowl when the lid 101 is lifted. It should be noted that lever 106 may include a stop feature that limits the travel to approximately 30 degrees as shown in call-out "A" in FIG. 1.

Figure 2:
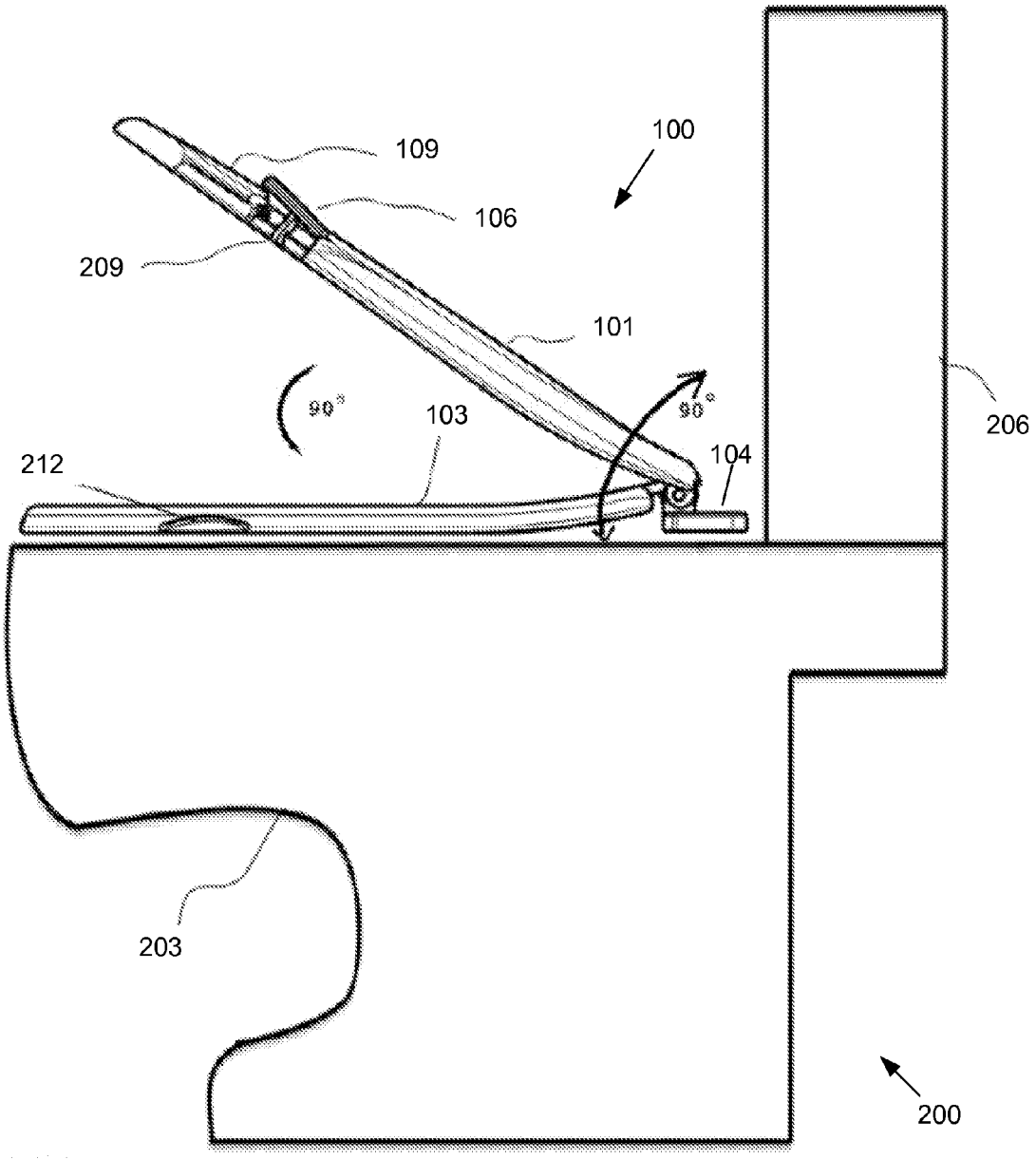

Moving on to FIG. 2, shown is a side view of the hook embodiment of the present disclosure with the lid 101 partially lifted. It also depicts a typical toilet comprising a bowl 203 and a tank 206. Both the lid 101 and the seat 103 can move slightly more than 90 degrees around hinges 104. FIG. 2 shows the underside of the lever 106 comprising a hook 209. FIG. 2 also shows the notch 212 in the seat 103 where the hook attaches. It should be noted that the hook 209 could instead engage a bulge in the side of the seat 103 rather than a notch 212 in other embodiments.

Figure 3:
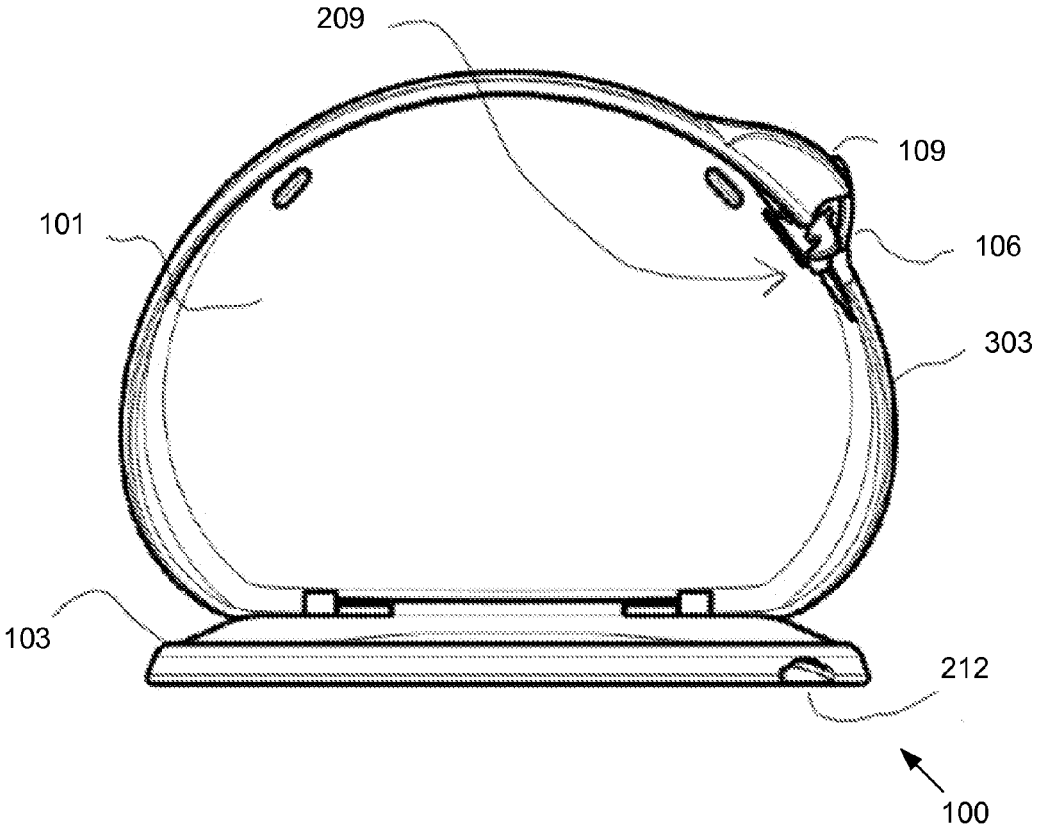

FIG. 3 shows another perspective of the hook embodiment of the present disclosure. Specifically, FIG. 3 illustrates the underside of the lid 101, with a more clearly visible hook 209 of the lever 106 being visible. FIG. 3 also identifies the skirt area 303 of the lid 101.

FIG. 4A shows a cross section of the integrated lid and seat 100, with hook 209 engaged in the notch 212. FIG. 4B shows an expanded view of this same cross section, with a hinge point 403 for the lever 106 being illustrated.

Figure 5:
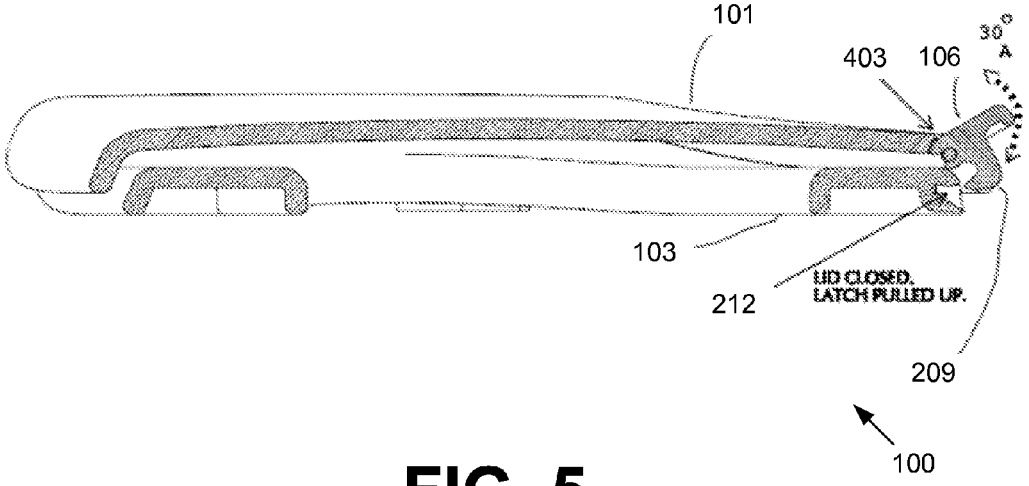

FIG. 5 shows a cross section of the integrated lid and seat 100 in the hook embodiment of the present disclosure. It details the movement of the lever 106 around hinge point 403, as the lever 106 would move when actuated with one or more fingers of the user during the lifting process for the lid 101 by itself.

Figure 6:
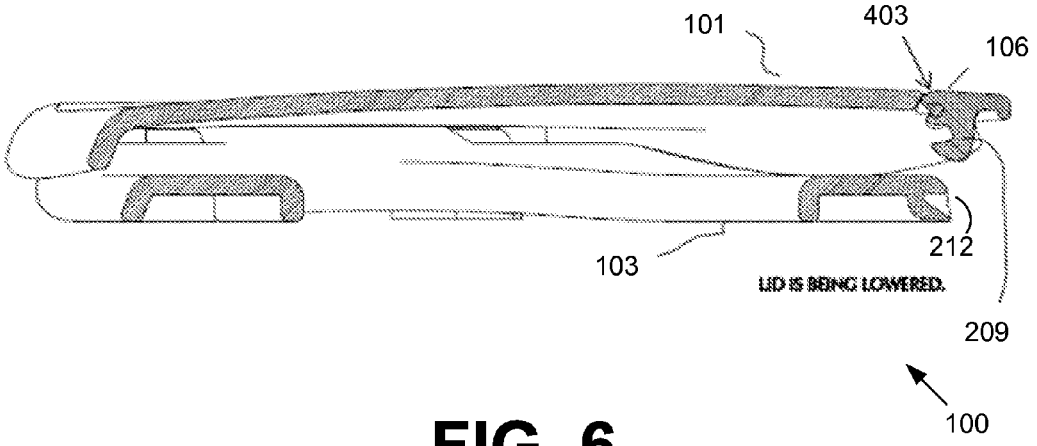

FIG. 6 shows a cross section of the hook embodiment of the present disclosure, this time shown as the lid 101 is being returned to a horizontal position. The lid 103 then rests on the seat 103, and the hook 209 will be engaging the seat 103. It should be noted that the hook embodiment as depicted in FIGS. 1-6 may not include a spring. Depending on the materials utilized, their coefficient of friction, and manufacturing dimensions and/or tolerances, a spring may be employed to ensure the that the hook 209 is biased to the downward position, except when used as a lift point. Various types of springs and various locations for the spring may be employed. The magnetic embodiment depicted in the following figures is less likely to employ a spring as the force of the magnets should return the apparatus to the latched position.

Figure 7:
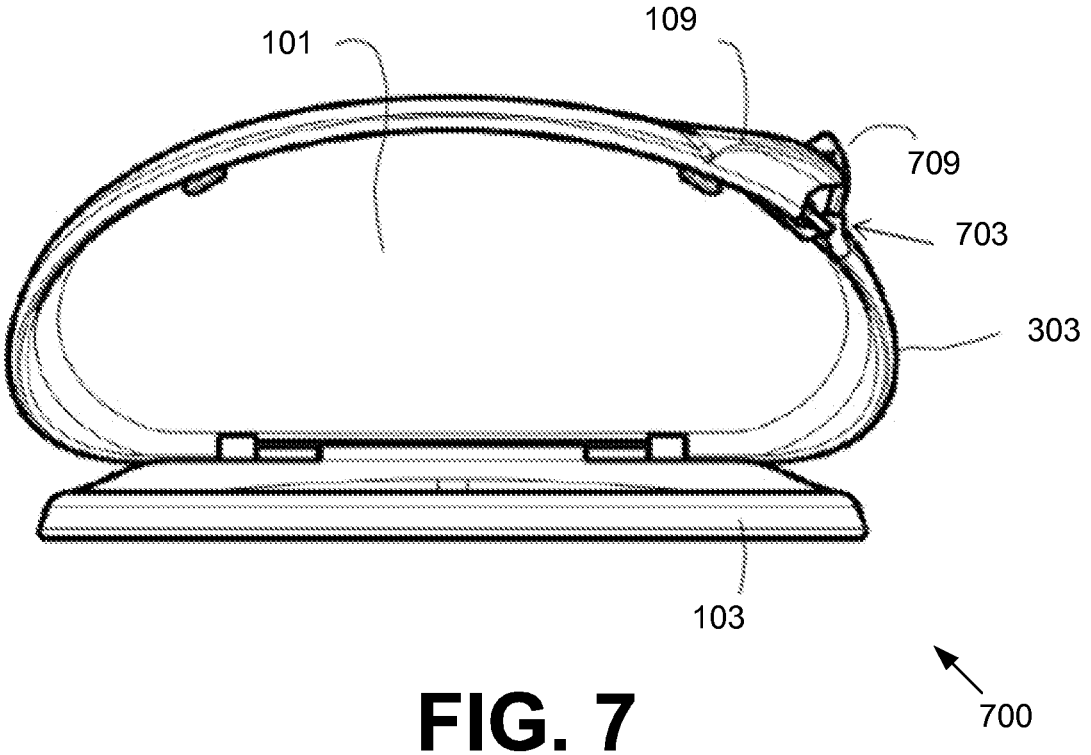

FIGS. 7-11 show different perspectives of a magnet embodiment 700 of the present disclosure. Starting with FIG. 7, a frontal view is shown that highlights the elements of this embodiment. The magnet embodiment 700 operates in the same way as the hook embodiment. The difference is the method for attaching the lid 101 to the seat 103. In this embodiment, the attachment method is magnetic. This magnetic attraction takes place at position 703, when the lid 101 is resting on the seat 103. The details of this attachment are more clearly illustrated in FIGS. 9-11. FIG. 7 shows the skirt area 303 of the lid 101 having the lever 706, this time with a magnetic component embedded at position 703.

Figure 8:
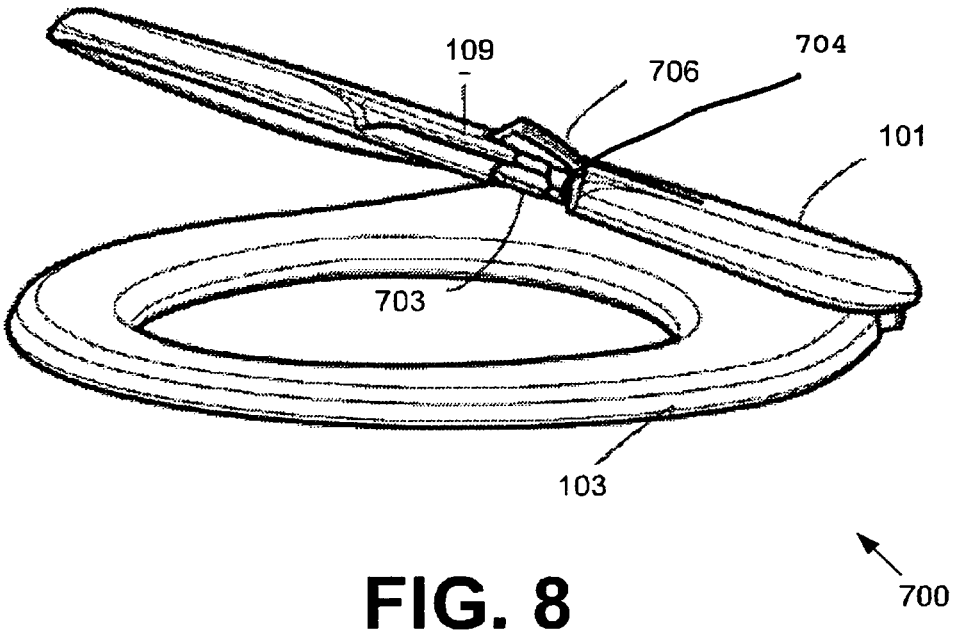

FIG. 8 shows a side/front perspective more clearly showing the grab point 109 of the lid 101, lever 706, positioned in an internal cavity 704 and the magnetic portion of the lever 706 at position 703. Although the magnetic latch positioned in the skirt 303 (FIG. 7) of the lid 101 is depicted, magnetic attachment may be used in other locations of the lid 101 and seat 103. In some embodiments, electromagnets may be used, allowing for electronic engage or disengage mechanisms.

Figure 9:
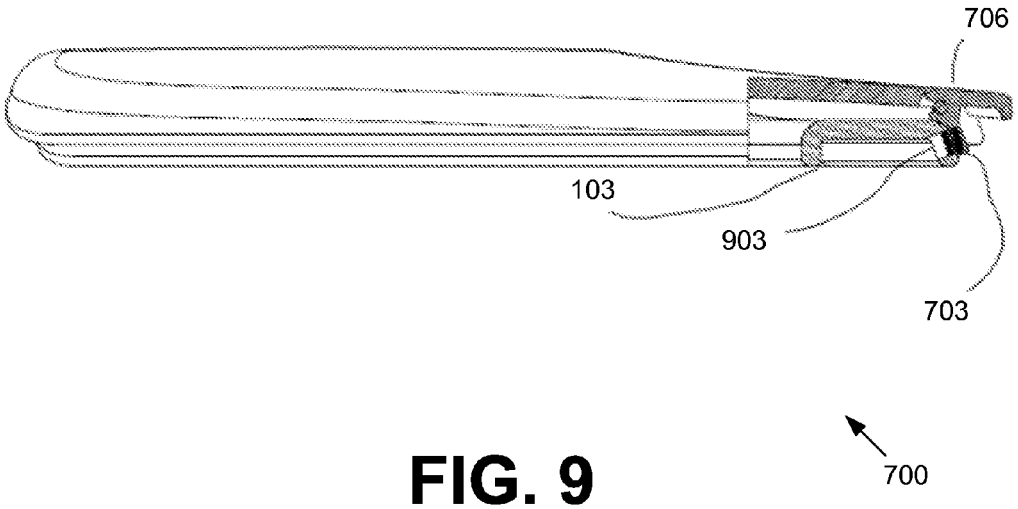

FIG. 9 shows a cross section of the lever 706 and seat 103 with a magnified view of the lever 706 area. This cross section shows the magnet at position 703 of the lever 706 magnetically attracted to the side of the toilet seat 103. This attraction may be due to complementary magnetic pole elements or magnets at positions 903 and 703. Where position 903 is embedded in or attached to the seat 103 attracting with the position 703 which may contain magnets or be manufactured with magnetic properties. This magnetic attraction may involve physical contact or just close proximity depending on the strength of the magnet used.

In one embodiment, the magnet is embedded in or attached to the side of the seat 103 as position 903. This magnet would attract a magnetic component installed or molded under the surface of the lever 706 that comes in contact or very close to the seat magnetic element at position 703. Another embodiment uses the opposite configuration, where the magnet is installed at position 703 attracting a magnetic element in the seat 103 at position 903. In yet another embodiment, both positions 703 and 903 contain magnets set to attract each other. In addition, it is possible that the lever 706 and/or the seat 103 could be manufactured from materials that already contain magnetic properties.

Figures 10A, 10B:
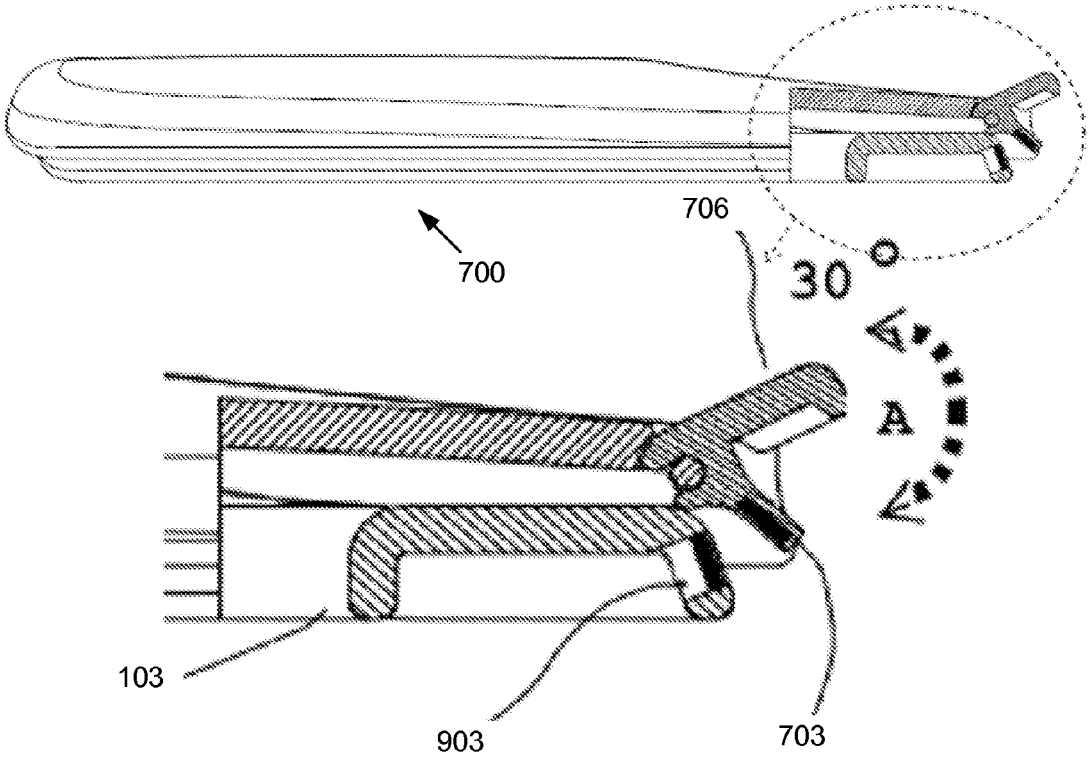
FIGS. 10A and 10B illustrate a cross section view of a toilet lid and toilet seat equipped with the magnet embodiment of the present disclosure. It is depicted with the lever lifted disengaging the seat.

FIG. 10A shows a slightly magnified cross section of the lid 101 (FIG. 7) and seat 103 with the disengagement of the magnetic attraction between the seat 103 and the lid 101 by means of raising the lever 706. FIG. 10B shows this same view magnified even more. This would occur during the lifting process for using the toilet in standing mode as described above in connection with the hook embodiment. This view also shows the approximate travel of 30 degrees for the lever 706, so that it can be used to easily lift the lid 103, with or without holding part of the hand on the fixed grab area 109 of the lid 103 (not shown in this cross section).

Figure 11:
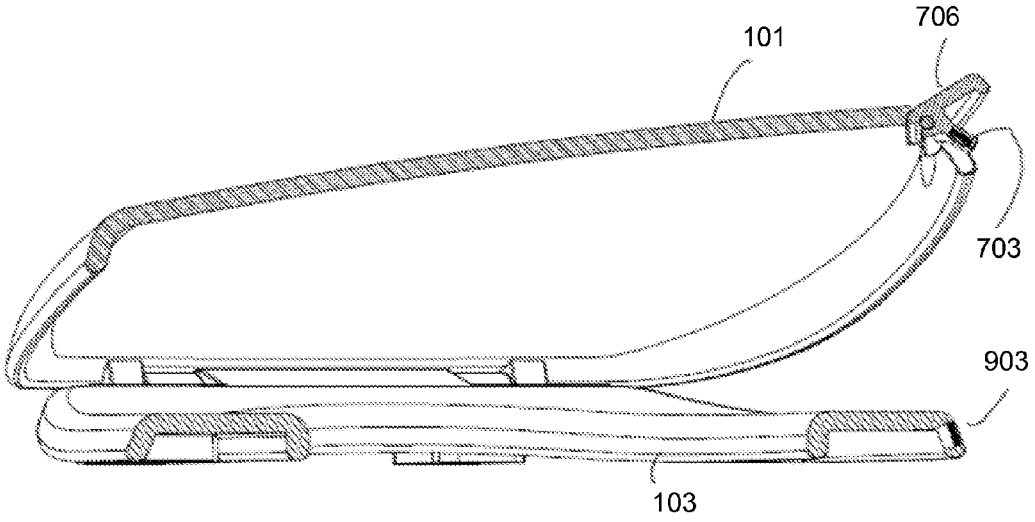

FIG. 11 shows a cross section of the lid 101 and seat 103 with the lid 101 being raised, after the disengagement of the seat 103.

Figure 12:
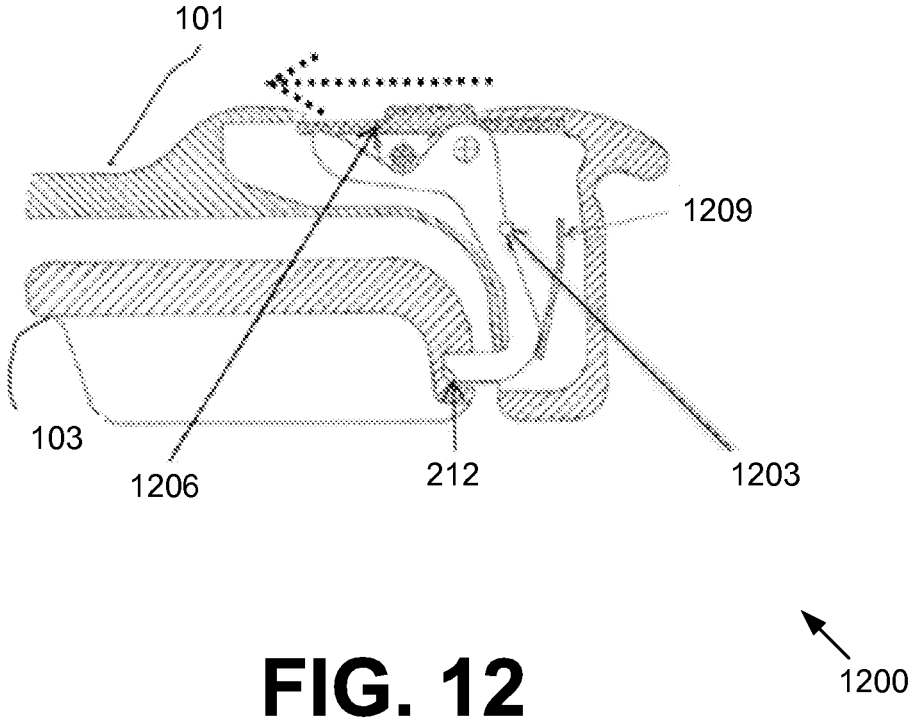
FIG. 12 illustrates a cross section of another embodiment of the present disclosure, where a slider is used to actuate the latching mechanism.

FIG. 12 shows yet another embodiment 1200 according to the present disclosure. This includes the use of a slider 1203 moving inside a cavity 1206 in the lid 101, thus inserting or retracting the latching member into or out of a notch 212 in seat 203. In this embodiment, a spring 1209 is employed to bias the apparatus in the engaged position. A magnetic attachment method using a slide may also be utilized.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A toilet seat and cover/lid assembly comprising a toilet seat adapted to be mounted on a toilet fixture for pivotal movement between raised and lowered positions and a toilet cover/lid also adapted to be mounted for movement between raised and lowered positions, the cover/lid overlying seat in the lowered position, where the cover/lid is resting on the seat and the seat is resting on the bowl, the cover/lid having a downwardly extending skirt along its periphery so that in the lowered position the skirt substantially conceals the peripheral edge of the toilet seat, a grab area integral with the cover/lid and extending outwardly relative to the skirt for use in raising and lowering the cover/lid alone or the cover/lid together with the toilet seat, and a latch mechanism for selectively coupling the toilet cover/lid to the toilet seat to permit the raising of the cover/ lid individually when the mechanism is disengaged together with the seat when the mechanism is engaged, at least a portion of the skirt of the cover/lid having an internal cavity at least partially receiving the latch mechanism, and a hand-operated actuator member for the latch mechanism being accessible from the outside of the cover/lid for controlling selective engagement/disengagement of the position of the latch mechanism, and a cooperable latch engagement member integral with the toilet seat periphery cooperating with a latching portion of the latch mechanism for releasably securing the seat to the cover/lid for raising/lowering the seat with the cover/lid.

2. The toilet seat and cover/lid assembly according to claim 1, wherein the latching mechanism comprises a pivotal latch member pivotally mounted inside the internal cavity.

3. The toilet seat and cover/lid assembly according to claim 2, wherein the latch member is spring biased into the engaged position.

4. The toilet seat and cover/lid assembly according to claim 2, wherein the latch member has two arms angled relative to each other, a first arm including the actuator member and extending outwardly and a second arm including at a distal end thereof the mechanical latching portion.

5. The toilet seat and cover/lid assembly according to claim 4, wherein the latching portion is distinct from and coupled to the second arm and extends substantial parallel to the first arm in a direction generally opposite to the first arm.

6. The toilet seat and cover/lid assembly according to claim 4, wherein the internal cavity is defined substantially entirely in the skirt of the cover/lid.

7. The toilet seat and cover/lid assembly according to claim 4, wherein the actuator comprises a slider mounted for reciprocal sliding movement on the cover/lid, the actuator having a camming portion cooperating with a first arm of the latch member for rocking the latch member between engaged and disengaged positions.

8. The toilet seat and cover/lid assembly according to claim 4, wherein the lid/cover has a substantially flat upper surface and the slider is mounted on and accessible through said upper surface.

9. The toilet seat and cover/lid assembly according to claim 4, wherein the latch engagement member comprises a notch or a bulge in a downwardly extending lip of the seat facing an inner wall of the skirt of the cover/lid.

10. The toilet seat and cover/lid assembly according to claim 2, wherein the latch engagement member comprises a notch in a downwardly extending lip of the seat facing an inner wall of the skirt of the cover/lid.

11. The toilet seat and cover/lid assembly according to claim 2, wherein the latch engagement member comprises a bulge in a downwardly extending lip of the seat facing an inner wall of the skirt of the cover/lid.

12. The toilet seat and cover/lid assembly according to claim 1, wherein the toilet cover/lid comprising a pivoting lever; the toilet seat hingedly attached to the toilet cover/lid, the toilet seat including an engagement area; and wherein the pivoting lever includes a hook configured to engage the toilet seat at the engagement area when in a downward position, thereby locking movement of the toilet cover/lid and the toilet seat, and the hook is configured to disengage from the engagement area when lifted upwardly, thereby facilitating independent movement of the toilet cover/lid away from the toilet seat.

13. A toilet seat and cover/lid assembly comprising a toilet seat adapted to be mounted on a toilet fixture for pivotal movement between raised and lowered positions and a toilet cover/lid also adapted to be mounted for movement between raised and lowered positions, the cover/lid overlying seat in the lowered position, a grab area integral with the lid and extending outwardly relative for use in raising and lowering the lid alone or the cover/ lid or together with the toilet seat, and a magnetic latch mechanism for selectively coupling the toilet cover/lid to the toilet seat to permit the raising of the cover/ lid individually when the mechanism is disengaged or together with the seat when the mechanism is engaged and a hand-operated actuator member for the latch mechanism being accessible when the lid is in the downward disposed position for controlling selective disengagement of the position of the latch mechanism, and a cooperable magnetic keeper member integral with the toilet seat and cover/lid periphery cooperating with a magnetic latching portion of the magnetic latch mechanism for releasably securing the seat to the cover/lid for raising/lowering the seat with the cover/lid.

14. The toilet seat and cover/lid assembly according to claim 13, wherein the lid having a downwardly extending skirt along its periphery so that in the lowered position the skirt substantially conceals the peripheral edge of the toilet seat, a grab area integral with the lid and extending outwardly relative to the skirt for use in raising and lowering the lid alone or the cover/lid or together with the toilet seat, and a magnetic latch mechanism for selectively coupling the toilet cover/lid to the toilet seat to permit the raising of the cover/ lid individually when the mechanism is disengaged or together with the seat when the mechanism is engaged with at least a portion of the skirt of the cover/lid having an internal cavity at least partially receiving the latch mechanism.

15. The toilet seat and cover/lid assembly according to claim 14, wherein the internal cavity is defined mainly in the skirt of the cover/lid.

16. The toilet seat and cover/lid assembly according to claim 13, wherein one of the magnetic latching portion and the cooperable magnetic keeper member comprises at least a magnet and the other of the magnetic latching portion and the cooperable magnetic keeper member comprises at least an associated pole piece.

17. The toilet seat and cover/lid assembly according to claim 13, wherein the magnetic latching mechanism comprises a pivotal latch member pivotally mounted inside the internal cavity.

18. The toilet seat and cover/lid assembly according to claim 13, wherein the pivotal latch member has two arms angled relative to each other, a first arm including the actuator member and extending outwardly and a second arm including at a distal end thereof the magnetic latching portion.

* * * * *